US010588211B2

(12) United States Patent
Beijsens et al.

(10) Patent No.: US 10,588,211 B2
(45) Date of Patent: Mar. 10, 2020

(54) RADIATION SOURCE HAVING DEBRIS CONTROL

(71) Applicant: ASML Netherlands B.V., Veldhoven (NL)

(72) Inventors: Rolf Theodorus Nicolaas Beijsens, Eindhoven (NL); Kornelis Frits Feenstra, 's-Gravenhage (NL); Arjen Teake De Jong, Barneveld (NL); Reinier Theodorus Martinus Jilisen, Eindhoven (NL); Niek Antonius Jacobus Maria Kleemans, Eindhoven (NL); Andrey Nikipelov, Eindhoven (NL); Pavel Seroglazov, Eindhoven (NL); Nicolaas Antonius Allegondus Johannes Van Asten, Breda (NL); Harald Ernest Verbraak, Maastricht (NL)

(73) Assignee: ASML Netherlands B.V., Veldhoven (NL)

( * ) Notice: Subject to any disclaimer, the term of this patent is extended or adjusted under 35 U.S.C. 154(b) by 851 days.

(21) Appl. No.: 15/035,983

(22) PCT Filed: Oct. 23, 2014

(86) PCT No.: PCT/EP2014/072753

§ 371 (c)(1),
(2) Date: May 11, 2016

(87) PCT Pub. No.: WO2015/071066

PCT Pub. Date: May 21, 2015

(65) Prior Publication Data

US 2016/0278196 A1 Sep. 22, 2016

Related U.S. Application Data

(60) Provisional application No. 62/002,051, filed on May 22, 2014, provisional application No. 61/904,872, filed on Nov. 15, 2013.

(51) Int. Cl.
*H05G 2/00* (2006.01)

(52) U.S. Cl.
CPC ..... *H05G 2/008* (2013.01); *H05G 2/005* (2013.01)

(58) Field of Classification Search
CPC ..... G01N 21/718; G01N 21/84; G01N 21/15; G01N 21/62; G03F 7/70033;
(Continued)

(56) References Cited

U.S. PATENT DOCUMENTS 7,084,982 B2 * 8/2006 Yamamoto ..... G01N 21/47 356/446
7,164,144 B2 1/2007 Partlo et al.
(Continued)

FOREIGN PATENT DOCUMENTS

JP 2007088267 4/2007
JP 2007109451 4/2007
(Continued)

OTHER PUBLICATIONS

Japanese Office Action issued in corresponding Japanese Application No. 2016-531702, dated Apr. 24, 2018, with English translation, 6 pages.
(Continued)

*Primary Examiner* — Brooke Purinton
(74) *Attorney, Agent, or Firm* — Pillsbury Winthrop Shaw Pittman LLP

(57) ABSTRACT

A radiation system to generate a radiation emitting plasma, the radiation system include a fuel emitter to provide a fuel target at a plasma formation region, a first laser arranged to provide a first laser beam at the plasma formation region incident on the fuel target to generate a radiation emitting plasma, an imaging device arranged to obtain a first image of the radiation emitting plasma at the plasma formation
(Continued)

region, the first image indicating at least one image property of the radiation emitting plasma, and a controller. The controller is arranged to receive the first image, and to generate at least one instruction based on the at least one image property of the radiation emitting plasma to modify operation of at least one component of the radiation system to reduce a detrimental effect of debris.

20 Claims, 5 Drawing Sheets

(58) Field of Classification Search
CPC ..... H01J 37/32357; H01J 37/32009; H01J 37/32917; H05G 2/008; H05G 2/005; H05G 2/003
See application file for complete search history.

(56) References Cited

U.S. PATENT DOCUMENTS

| | | | | |
|---|---|---|---|---|
| 8,519,366 | B2 | 8/2013 | Bykanov et al. | |
| 9,268,031 | B2 * | 2/2016 | Umstadter | H05G 2/003 |
| 2005/0199829 | A1 | 9/2005 | Partlo et al. | |
| 2005/0205810 | A1 * | 9/2005 | Akins | B82Y 10/00 250/504 R |
| 2010/0032590 | A1 | 2/2010 | Bykanov et al. | |
| 2011/0284775 | A1 | 11/2011 | Ueno et al. | |
| 2011/0309260 | A1 | 12/2011 | Nishisaka et al. | |
| 2013/0256568 | A1 | 10/2013 | Endo et al. | |
| 2013/0313423 | A1 * | 11/2013 | Umstadter | H05G 2/003 250/282 |
| 2013/0319466 | A1 * | 12/2013 | Mizoguchi | G03F 7/70925 134/18 |
| 2019/0101831 | A1 * | 4/2019 | Chung | G03F 7/2004 |

FOREIGN PATENT DOCUMENTS

| | | |
|---|---|---|
| JP | 2007-529869 | 10/2007 |
| JP | 2012109218 | 6/2012 |
| WO | 2005-089130 | 9/2005 |
| WO | 2011013779 | 2/2011 |

OTHER PUBLICATIONS

International Search Report and Written Opinion dated Feb. 17, 2015 in corresponding International Patent Application No. PCT/EP2014/072753.

Tao Wu et al., "Debris mitigation power of various buffer gases for $CO^2$ laser produced tin plasmas," J. Phys. D: Appl. Phys., vol. 45, No. 47, pp. 1-6 (Nov. 1, 2012).

Japanese Office Action issued in corresponding Japanese Patent Application No. 2016-531702, dated Oct. 23, 2018.

* cited by examiner

RADIATION SOURCE HAVING DEBRIS CONTROL

CROSS-REFERENCE TO RELATED APPLICATIONS

This application is the U.S. national phase entry of PCT patent application no. PCT/EP2014/072753, which was filed on Oct. 23, 2014, which claims the benefit of priority of U.S. provisional application No. 61/904,872 which was filed on Nov. 15, 2013 and U.S. provisional application No. 62/002,051, which was filed on May 22, 2014, and which are incorporated herein in their entirety by reference.

FIELD

The present invention relates to methods and systems for generating radiation.

BACKGROUND

A lithographic apparatus is a machine constructed to apply a desired pattern onto a substrate. A lithographic apparatus can be used, for example, in the manufacture of integrated circuits (ICs). A lithographic apparatus may for example project a pattern from a patterning device (e.g. a mask) onto a layer of radiation-sensitive material (resist) provided on a substrate.

The wavelength of radiation used by a lithographic apparatus to project a pattern onto a substrate determines the minimum size of features which can be formed on that substrate. A lithographic apparatus which uses EUV radiation, being electromagnetic radiation having a wavelength within the range 5-20 nm, may be used to form smaller features on a substrate than a conventional lithographic apparatus (which may for example use electromagnetic radiation with a wavelength of 193 nm).

EUV radiation may be produced using a radiation source arranged to generate an EUV producing plasma. An EUV producing plasma may be generated, for example, by exciting a fuel within the radiation source. In addition to generation of plasma, exciting the fuel may also result in the unwanted generation of particulate debris from the fuel. For example, where a liquid metal, such as tin, is used as a fuel, some of the liquid metal fuel will be converted into an EUV producing plasma, but debris particles of the liquid metal fuel may be emitted at high speeds from the plasma formation region. The debris may be incident on other components within the radiation source, affecting the ability of the radiation source to generate an EUV producing plasma or to provide a beam of EUV radiation from the plasma to other components of the lithographic apparatus. The debris may also travel beyond the radiation source and become incident on other components of the lithographic apparatus.

SUMMARY

It is an object of an embodiment described herein to obviate or mitigate one or more of the problems set out above.

According to a first aspect described herein, there is provided a radiation system for generating a radiation emitting plasma. The radiation system comprises a fuel emitter for providing a fuel target at a plasma formation region and a first laser arranged to provide a first laser beam at the plasma formation region such that in use the first laser beam is incident on the fuel target to generate a radiation emitting plasma. The radiation system further comprises an imaging device arranged to obtain a first image of a radiation emitting plasma at the plasma formation region the first image indicating at least one image property of the radiation emitting plasma, and a controller. The controller is arranged to receive the first image, and generate at least one instruction based on the at least one image property, the at least one instruction being suitable for modifying operation of at least one component of the radiation system to reduce a detrimental effect of debris from generation of the radiation emitting plasma. The at least one instruction may be transmitted to a further component (such as the at least one component) and/or may be executed to effect the modification of operation of the at least one component.

In this way, detrimental effects of debris which result from generation of the radiation emitting plasma may be reduced based on images of the plasma, rather than tracking and imaging fuel targets and/or the debris itself. As such, it is possible to avoid the use of complicated shadowgraph techniques tracking fuel targets and debris. Such shadowgraph techniques require powerful lasers to backlight the fuel targets and complex timing mechanisms to ensure that an imaging device, backlight laser and fuel target are synchronized. The at least one image property may comprise an amount and/or a direction of debris from generation of the radiation emitting plasma. It has been found that properties of the plasma which may be quickly and efficiently determined from images of the plasma may be used to determine properties of debris emitted during generation of that plasma.

The at least one instruction may be suitable for altering an interaction between the first laser beam and the fuel target. By controlling an interaction between the first laser and the fuel target, properties of the generated plasma may be controlled in order to reduce detrimental effects of debris. For example, an interaction between the first laser beam and the fuel target may be altered so as to cause a larger portion of the fuel target to be within a beam waist of the first laser beam, thereby reducing a quantity of debris produced.

The at least one instruction may comprise an instruction for causing the fuel emitter to change a fuel property of the fuel target. For example, the instruction may cause the fuel emitter to change one or more of a speed, direction of propagation, size and shape of the fuel target. By altering fuel properties of the fuel target, plasma properties of the plasma, and therefore the debris emitted during generation of that plasma may be controlled to achieve a desired effect.

The at least one instruction may comprise an instruction suitable for controlling a first laser property of the first laser beam. For example, the first laser may be a pulse laser and the first laser property of the first laser beam may comprise a repetition rate of the pulse laser, a pulse length and a pulse shape (i.e. an intensity profile of the pulse in time). Additionally or alternatively, the first laser property of the first laser beam may comprise a power, intensity profile, direction of propagation and/or position of the first laser beam.

The radiation system may further comprise a second laser arranged to provide a second laser beam incident on the fuel target to alter a fuel property of the fuel target before the first laser beam is incident on the fuel target. The second laser beam may be referred to as a pre-pulse. The at least one instruction may comprise an instruction suitable for controlling a second laser property of the second laser beam.

The at least one image property of the radiation emitting plasma may comprise at least one of an angle, intensity and/or elipticity of the radiation emitting plasma. It has been found that these particular image properties may be easily and efficiently determined from images generated by the first imaging device. In particular, each of these image properties may be generated with sufficient speed to be used in a feedback control loop to continuously adjust components of the radiation system to achieve a desired reduction in detrimental effects of debris.

The radiation system may further comprise a contamination trap, and the at least one instruction may comprise an instruction suitable for causing debris to be emitted in a direction substantially towards the contamination trap. In this way, the contamination trap may be most effectively used to reduce detrimental effects caused by the debris. Additionally or alternatively, the at least one instruction may comprise an instruction suitable for altering operation of the contamination trap to trap a greater portion of an emitted debris. For example, where the contamination trap comprises a rotating foil trap, a speed of rotation of the rotating foil trap may be adjusted by the instruction.

The radiation system may further comprise a second imaging device arranged to obtain a second image of the radiation emitting plasma at the plasma formation region. The computer readable instructions may comprise instructions suitable for receiving the second image and for determining the at least one property of the radiation emitting plasma from the first and second image. In this way, a more accurate determination of properties of the plasma may be made, and therefore more the generated instructions may be more effective in reducing detrimental effects of debris.

The first imaging device may be arranged to obtain images in a first plane and the second imaging device may be arranged to obtain images in a second plane substantially orthogonal to the first plane. The first imaging device may be arranged to obtain images in a plane substantially parallel to a direction of propagation of the first laser beam and at 45 or 225 degrees with respect to a direction of propagation of the fuel target. The second imaging device may be arranged to obtain images in a plane substantially parallel to a direction of propagation of the first laser beam and at −45 or −225 degrees with respect to the direction of propagation of the fuel target.

The at least one instruction may suitable for minimizing a quantity of debris generated by generation of the radiation emitting plasma.

The radiation source may further comprise a focusing assembly having at least one movable optical component. The instruction may be suitable for causing movement of the at least one movable optical component.

The first imaging device may be a CMOS, but any suitable imaging device may be used. In other embodiments, the imaging device may be an analogue imaging device. Receiving the first image may comprise receiving one or more analogue signals from the first imaging device.

The controller may comprise one or more controllers. The controller may be implemented using one or more processing devices. The controller may comprise a digital processor arranged to process the first image to determine the at least one image property that is indicated in the first image. Alternatively, the controller (or plurality of controllers) may comprise one or more analogue components arranged to generate analogue signals in response to the first image.

The radiation source may further comprise an illumination source arranged to provide first illumination radiation to illuminate the plasma formation region when the imaging device obtains the first image. The imaging device may be arranged to obtain a second image of the radiation emitting plasma at a predetermined time after obtaining the first image and the illumination source may be arranged to provide second illumination radiation when the imaging device obtains the second image. The controller may be arranged to process the first and second images to determine at least one of size, speed and direction of a particle emitted from the radiation generated plasma. Generating said at least one instruction may be based upon said determined at least one of size, speed and direction of said particle emitted from the radiation generated plasma.

The illumination source may comprise a laser arranged to emit an illumination laser beam pulse and conditioning optics arranged to condition the laser beam pulse to provide the first and second illumination radiation. The laser may have a wavelength different to both the first laser beam and the second laser beam.

The conditioning optics may be arranged to flatten said first and second illumination radiation to provide substantially planar radiation.

The conditioning optics may be arranged to rotate said first and second radiation through a plurality of planes. For example, the conditioning optics may comprise a single rotatable cylindrical lens. Alternatively, the conditioning optics may comprise a plurality of rotatable cylindrical lenses.

The illumination source may be arranged such that the first and second illumination radiation each comprise a volume of illumination.

The predetermined time between obtaining the first and second images may be less than or equal to approximately 10 ms.

The controller may be arranged to determine a size of the particle emitted from the radiation generated plasma by determining from the first and/or second image a property of photons scattered by the particle.

The controller may be arranged to determine a size of said particle by processing said determined property of photons using the Mie solution for the scattering of electromagnetic radiation by a sphere.

Determining at least one of a distance and a speed of said particle may comprise cross-correlating the first and second images to determine a distance travelled by the particle between the images. Determining a speed of the particle may comprise determining the speed based upon a known time between acquisition of the first and second images in combination with the determined distance.

Determining at least one of a distance and a speed may comprise processing the first and second image using velocimetry techniques to determine a velocity of said particle.

According to a second aspect described herein, there is provided a method of generating a radiation emitting plasma in a radiation system comprising a fuel emitter for providing a fuel target at a plasma formation region, a first laser arranged to provide a first laser beam at the plasma formation region incident on the fuel target to generate a radiation emitting plasma and an imaging device arranged to obtain images of a radiation emitting plasma at the plasma formation region. The method comprises executing at a controller computer readable instructions to: receive a first image of a radiation emitting plasma, determine at least one image property of the radiation emitting plasma from the image, generate at least one instruction based on the at least one image property, the at least one instruction being suitable for modifying at least one component of the radiation system to reduce a detrimental effect of debris.

According to a third aspect, there is provided a lithographic tool comprising a radiation system according to the first aspect.

According to a fourth aspect, there is provided a radiation source for generating a radiation emitting plasma, the radiation source being arranged to receive a laser beam at a plasma formation region and comprising: a fuel emitter for providing a fuel target at the plasma formation region; an imaging device arranged to obtain a first image of a radiation emitting plasma at the plasma formation region; and a control system arranged to: receive the first image; determine at least one image property of the radiation emitting plasma from the first image; generate at least one instruction based on the at least one image property of the radiation emitting plasma to modify operation of at least one component of a radiation system to reduce a detrimental effect of debris; and execute the at least one instruction.

The radiation system may be a radiation system in which the radiation source is used. For example, the radiation system may comprise the radiation source and a laser arranged to provide a laser beam at the plasma formation region.

According to a fifth aspect, there is provided a non-transitory computer readable medium carrying computer readable instructions suitable to cause a computer to: receive a first image of a radiation emitting plasma; determine at least one image property of the radiation emitting plasma from the image; generate at least one instruction based on the at least one image property of the radiation emitting plasma to modify operation of at least one component of a radiation system to reduce a detrimental effect of debris; and execute the at least one instruction.

It will be appreciated that aspects of the present invention can be implemented in any convenient way including by way of suitable hardware and/or software. Alternatively, a programmable device may be programmed to implement embodiments of the invention. The invention therefore also provides suitable computer programs for implementing aspects of the invention. Such computer programs can be carried on suitable carrier media including tangible carrier media (e.g. hard disks, CD ROMs and so on) and Intangible carrier media such as communications signals.

One or more aspects of the invention may be combined with any one or more other aspects described herein, and/or with any one or more features described herein.

BRIEF DESCRIPTION OF THE DRAWINGS

Embodiments of the invention will now be described, by way of example only, with reference to the accompanying schematic drawings, in which.

DETAILED DESCRIPTION

Figure 1:
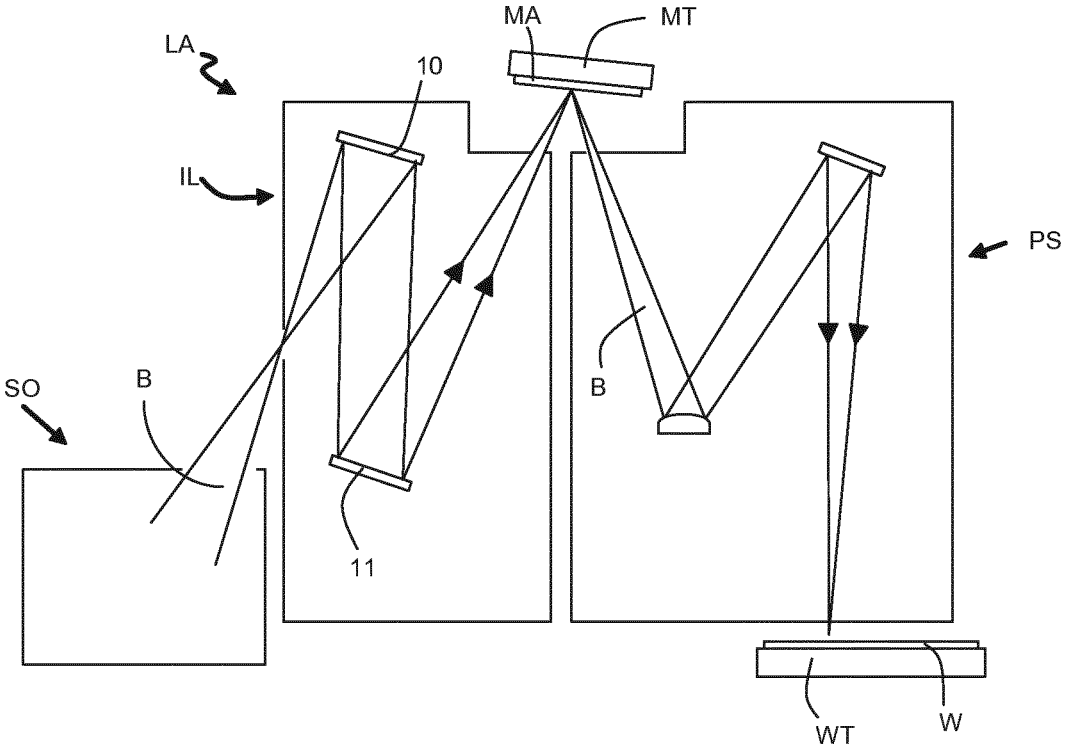
FIG. 1 schematically depicts a lithographic system comprising a lithographic apparatus and a radiation source according to an embodiment of the invention.

FIG. 1 shows a lithographic system including a radiation source SO according to one embodiment of the invention. The lithographic system comprises a radiation source SO and a lithographic apparatus LA. The radiation source SO is configured to generate an extreme ultraviolet (EUV) radiation beam B. The lithographic apparatus LA comprises an illumination system IL, a support structure MT configured to support a patterning device MA (e.g. a mask), a projection system PS and a substrate table WT configured to support a substrate W. The illumination system IL is configured to condition the radiation beam B before it is incident upon the patterning device MA. The projection system is configured to project the radiation beam B (now patterned by the mask MA) onto the substrate W. The substrate W may include previously formed patterns. Where this is the case, the lithographic apparatus aligns the patterned radiation beam B with a patter previously formed on the substrate W.

The radiation source SO, illumination system IL, and projection system PS may all be constructed and arranged such that they can be isolated from the external environment. A gas at a pressure below atmospheric pressure (e.g. hydrogen) may be provided in the radiation source SO. A vacuum may be provided in illumination system IL and/or the projection system PS. A small amount of gas (e.g. hydrogen) at a pressure well below atmospheric pressure may be provided in the illumination system IL and/or the projection system PS.

The illumination system IL may include a facetted field mirror device 10 and a facetted pupil mirror device 11. The faceted field mirror device 10 and faceted pupil mirror device 11 together provide the radiation beam B with a desired cross-sectional shape and a desired angular distribution. The radiation beam B passes from the illumination system IL and is incident upon the patterning device MA held by the support structure MT. The patterning device MA reflects and patterns the radiation beam B. The illumination system IL may include other mirrors or devices in addition to or instead of the faceted field mirror device 10 and faceted pupil mirror device 11.

Following reflection from the patterning device MA the patterned radiation beam B enters the projection system PS. The projection system comprises a plurality of mirrors which are configured to project the radiation beam B onto a substrate W held by the substrate table WT. The projection system PS may apply a reduction factor to the radiation beam, forming an image with features that are smaller than corresponding features on the patterning device MA. A reduction factor of 4 may for example be applied. Although the projection system PS has two mirrors in FIG. 1, the projection system may include any number of mirrors (e.g. six mirrors).

Figure 2:
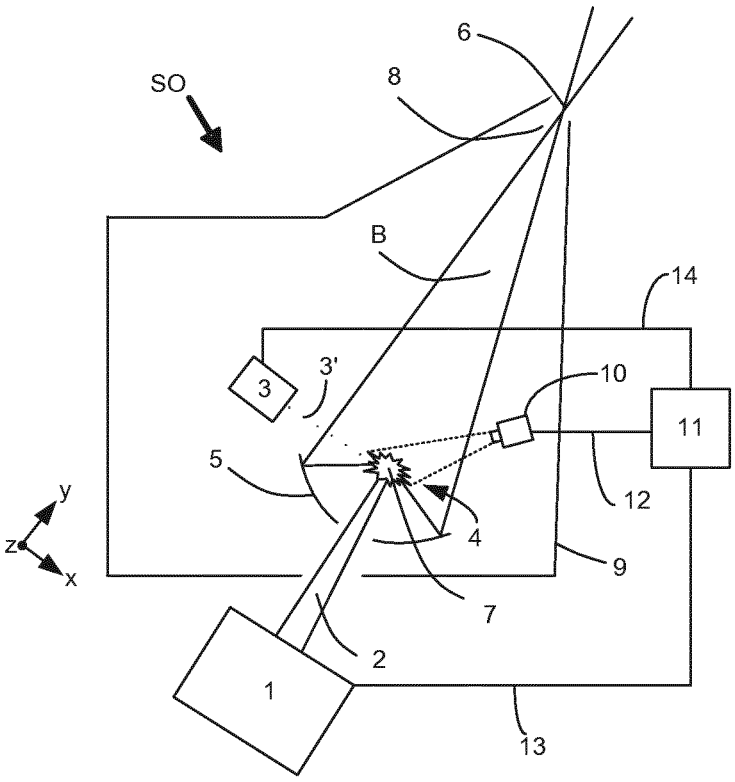
FIG. 2 schematically depicts an example radiation source according to an embodiment of the invention.

An example of the radiation source SO is shown in FIG. 2. The radiation source SO shown in FIG. 2 is of a type which may be referred to as a laser produced plasma (LPP) source). A laser 1, which may for example be a $CO_2$ laser, is arranged to deposit energy via a laser beam 2 into a fuel, such as tin (Sn) which is provided from a fuel emitter 3. The laser may be, or may operate in a fashion of, a pulsed, continuous wave or quasi-continuous wave laser. The trajectory of fuel emitted from the fuel emitter is parallel to an x-axis marked on FIG. 3. The laser beam 2 propagates in a direction parallel to a y-axis, which is perpendicular to the x-axis. A z-axis is perpendicular to both the x-axis and the z-axis and extends generally into (or out of) the plane of the page.

Although a tin fuel is described in the following description, any suitable fuel may be used. The fuel may for example be in liquid form, and may for example be a metal or alloy. The fuel emitter 3 may comprise a nozzle configured to direct tin, shown in the form of droplets 3', along a trajectory towards a plasma formation region 4. The laser beam 2 is incident upon the tin at the plasma formation region 4. The deposition of laser energy into the tin creates a plasma 7 at the plasma formation region 4. Radiation, including EUV radiation, is emitted from the plasma 7 during de-excitation and recombination of ions of the plasma.

The EUV radiation is collected and focused by a near normal incidence radiation collector 5 (sometimes referred to more generally as a normal incidence radiation collector). The collector 5 may have a multilayer structure which is arranged to reflect EUV radiation (e.g. EUV radiation having a desired wavelength such as 13.5 nm). The collector 5 may have an elliptical configuration, having two ellipse focal points. A first focal point may be at the plasma formation region 4, and a second focal point may be at an intermediate focus 6, as discussed below.

The laser 1 may be separated from the radiation source SO. Where this is the case, the laser beam 2 may be passed from the laser 1 to the radiation source SO with the aid of a beam delivery system (not shown) comprising, for example, suitable directing mirrors and/or a beam expander, and/or other optics. The laser 1 and the radiation source SO may together be considered to be a radiation system.

Radiation that is reflected by the collector 5 forms the radiation beam B. The radiation beam B is focused at point 6 to form an image of the plasma formation region 4, which acts as a virtual radiation source for the illumination system IL. The point 6 at which the radiation beam B is focused may be referred to as the intermediate focus. The radiation source SO is arranged such that the intermediate focus 6 is located at or near to an opening 8 in an enclosing structure 9 of the radiation source.

The radiation source SO (or radiation system) further comprises an imaging device in the form of a camera 10 arranged to obtain images of the plasma 7. The camera 10 may comprise a CCD array or a CMOS sensor, but it will be appreciated that any imaging device suitable for obtaining images of the plasma 7 may be used. It will be appreciated that the camera 10 may comprise optical components in addition to a photodetector. The optical components may be selected so that the camera 10 obtains near-field images and/or far-field images. The camera 10 may be positioned within the radiation source SO at any appropriate location from which the camera has a line of sight to the plasma 7. It may be necessary, however, to position the camera 10 away from the propagation path of both the laser beam 2 and the fuel emitted from the fuel emitter 3 so as to avoid damage to the camera 10. The camera 10 is arranged to provide images of the plasma 7 to a controller 11 via a connection 12. The connection 12 is shown as a wired connection, though it will be appreciated that the connection 12 (and other data connections referred to herein) may be implemented as either wired or wireless connections.

Figure 3:
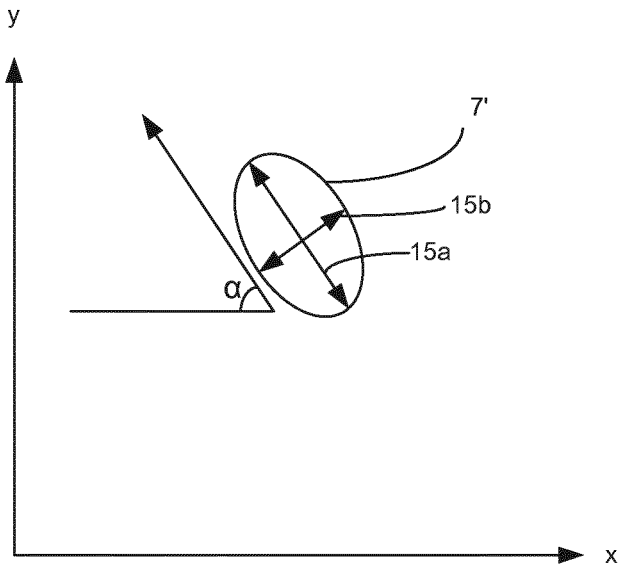
FIG. 3 depicts an image of a plasma processed by a controller of FIG. 2.

The controller 11 is configured to process the received images of the plasma 7 to automatically determine at least one parameter indicating an image property of the plasma 7. FIG. 3 shows a representation of an image 7 of a plasma 7 in an x-y plane (axes are illustrated in FIG. 2 for reference) that may be processed by the controller 11. It will be appreciated that the camera 10 may be arranged to image the plasma 7 in planes other than the x-y plane. Example, image properties that may be generated by the controller 11 from the images of the plasma 7 include an angle of the plasma (with respect to axes of a defined coordinate system), an intensity profile and/or an elipticity of the plasma 7. For example, an angle $\alpha$ with respect to the direction of propagation of the fuel (i.e. the x-axis) is shown in FIG. 3, but it will be readily appreciated that angles with respect to the other axes may equally be determined. The image 7' may be processed to determine a polar radius 15*a* and an equatorial radius 15*b* so as to determine an elipticity (or flattening) of the plasma 7. An intensity profile of the plasma 7 may be generated through analysis of the pixels making up the image 7' may be processed to determine an intensity at corresponding portions of the plasma 7.

Generally, it will be appreciated that the controller 11 may be implemented in any appropriate way. For example, the controller 11 comprise one or more digital processors and may be implemented as an FGPA, ASIC or a suitably programmed general purpose computer. Further, processing of the plasma images at the controller 11 may be performed in any appropriate way using any image processing techniques as will be readily apparent to those skilled in the art. For example, image processing techniques such as edge detection may be used to detect a shape of the plasma 7, while image smoothing techniques may be used to reduce noise.

The image properties are used to generate instructions to be provided to components of the radiation system (e.g. the radiation source SO and the laser 1). For example, the image properties may be used by the controller 11 to determine properties of debris emanating from the plasma formation region 4. Instructions may then be provided to one or more components of the radiation system in dependence upon the determined properties. For example, the image properties may be used to determine an amount, direction and/or quality of debris (such as size of particles, distribution of particles, etc) emanating from the plasma formation region 4.

That is, it has been determined that image properties of the plasma 7, as may be determined from plasma images obtained by the camera 10, are suitable for determining image properties of debris emanating from the plasma 7. For example, it has been determined that an intensity profile of the plasma 7 is indicative of an amount of debris emitted by the plasma 7 and that an elipticity and angle of the plasma 7 are indicative of a direction of propagation of debris. The instructions generated by the controller 11 based on the determined image properties of debris emanating from the plasma formation region 4 and provided to components of the radiation system, may be instructions chosen to adjust those components, or adjust operation of those components, so as to reduce one or more detrimental effects of the debris. Detrimental effects may include, for example, incidence of debris on mechanical, electrical or optically active components of either the radiation source SO (such as lenses, mirrors, windows etc), or components of an apparatus "downstream" of the radiation source SO.

While a plurality of examples are described herein, it will be understood from the teaching herein that detrimental effects of debris may be reduced in any of a plurality of ways and that the invention is not limited to reduction by any particular method. For example, reducing detrimental effects may comprise reducing an amount of debris emitted, altering a direction of emitted debris or altering another quality of the emitted debris, such as particle size or particle distribution. By altering a direction of the debris, for example, a portion of the emitted debris propagating in a direction of debris mitigation devices (not shown in FIG. 2) may be increased. Similarly, debris particle sizes and/or distributions may be controlled so as to remain substantially within a range in which employed debris mitigation mechanisms are most effective.

In FIG. 2, the controller 11 is shown to be connected to the laser 1 by a connection 13. The controller 11 may therefore provide instructions to the laser 1 over the connection 13 in order to adjust a laser property of the laser beam 2 in response to image properties determined about the plasma 7 and/or the debris emanating from the plasma formation region 4. By controlling the laser 1 to adjust the laser beam 2, interaction between the laser beam 2 and the fuel target may be changed. For example, a direction and/or angle at which the laser beam 2 is incident on the fuel target may be adjusted. In this way, for example, the laser beam 2 may strike the fuel target at a different location on the surface of the fuel target, or at a different angle. Further examples of laser properties of the laser beam 2 which may be controlled include changes to a total power of the laser beam 2, changes to an intensity distribution in the laser beam 2 (particularly at the plasma formation region 4), and a size/shape of the laser beam 2 at the plasma formation region 4. Where the laser 1 is a pulsed laser such that the laser beam 2 is a laser pulse, the laser 1 may be controlled to vary the pulse repetition rate, the pulse length and the intensity profile of the laser pulse over time (pulse shape). Other modifications to the laser beam 2 will, however, be readily apparent to the skilled person based on the teaching herein.

By controlling the interaction between the laser beam 2 and the fuel target, properties of the generated plasma may thereby be altered, and consequently, properties of the debris are also altered. For example, the adjustments to the laser beam 2 described above may be used to increase a portion of the fuel target that is within the beam waist of the laser beam 2, thereby increasing the portion of the fuel target that is converted into the plasma 7 and reducing a portion of the fuel target that emanates as debris.

The controller 11 is further connected to the fuel emitter 3 via a connection 14. In this way, the controller 11 is provided with additional means to control plasma generation, and therefore debris, within the radiation source SO. In particular, the controller 11 may be configured to issue commands to the fuel emitter 3 in order to alter properties of the emitted fuel 3', such as shape, speed, size, etc. The fuel emitter 3 and hence the nozzle of the fuel emitter (not shown) may be moveable relative to the other components of the radiation source SO (and in particular relative to the radiation collector CO) by at least one actuator (not shown) mechanically linked to the fuel emitter 3. The fuel emitter 3 may, for example, be moveable by the at least one actuator within the y-z plane in response to instructions received from the controller 11. However, it will be appreciated that in other embodiments of the invention, the fuel emitter 3 may additionally or alternatively be moveable in a direction parallel to the x-axis. Furthermore, in other embodiments of the invention, the fuel emitter 3 may be tilted relative to the x-axis. Further adjustments to fuel provided by the fuel emitter 3 may be made by adjustments to a nozzle (not shown) of the fuel emitter 3, such as expansion, constriction, or change of shape of the nozzle. Indeed, it will be appreciated that any suitable properties of the fuel emitter 3 may be adjusted as appropriate to obtain a desired property of the plasma 7.

Upon adjusting a property of the plasma 7, the effect of that adjustment is imaged by the camera 10, and provided to the controller 11 which may make additional adjustments on the basis thereof. The controller 11 therefore establishes a control loop in which properties of the plasma 7 may be iteratively controlled in response to feedback indicating changing conditions of the plasma 7 from the camera 10.

Figure 4:
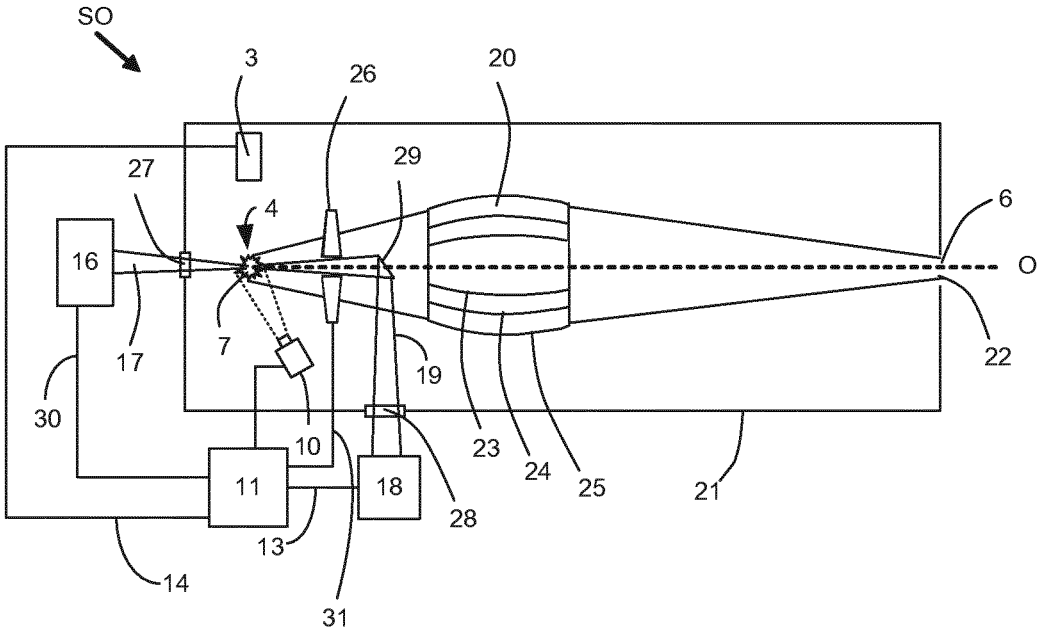
FIG. 4 schematically depicts an alternative radiation source according to an embodiment of the invention.

FIG. 4 schematically illustrates a radiation system including a laser produced plasma (LPP) radiation source SO according to another embodiment, which has an alternative configuration to the radiation source shown in FIG. 2. Where components of the radiation source SO of FIG. 4 have equivalent components in the radiation source SO of FIG. 2, like reference numerals have been used. The radiation source SO of FIG. 4 includes a fuel emitter 3 which is configured to deliver fuel to a plasma formation region 4. As described above, the fuel may be provided in the form of tin droplets, but fuel of any suitable material or form may be used. A pre-pulse laser 16 emits a pre-pulse laser beam 17 which is incident upon the fuel. The pre-pulse laser beam 17 acts to preheat the fuel, thereby changing a property of the fuel such as its size, shape and/or trajectory. A main laser 18 emits a main laser beam 19 which is incident upon the fuel after the pre-pulse laser beam 17. The main laser beam 18 delivers energy to the fuel and thereby coverts the fuel into an EUV radiation emitting plasma 7.

A radiation collector 20, which may be a so-called grazing incidence collector, is configured to collect the EUV radiation and focus the EUV radiation at a point 6 which may be referred to as the intermediate focus. Thus, an image of the radiation emitting plasma 7 is formed at the intermediate focus 6. An enclosure structure 21 of the radiation source SO includes an opening 22 which is at or near to the intermediate focus 6. The EUV radiation passes through the opening 22 to an illumination system of a lithographic apparatus (e.g. of the form shown schematically in FIG. 1).

The radiation collector 20 may be a nested collector, with a plurality of grazing incidence reflectors 23, 24 and 25 (e.g. as schematically depicted). The grazing incidence reflectors 23, 24 and 25 may be disposed axially symmetrically around an optical axis O. The illustrated radiation collector 20 is shown merely as an example, and other radiation collectors may be used.

A contamination trap 26 is located between the plasma formation region 4 and the radiation collector 20. The contamination trap 26 may, for example, be a rotating foil trap, or may be any other suitable form of contamination trap. In some embodiments the contamination trap 26 may be omitted.

An enclosure 21 of the radiation source SO includes a window 27 through which the pre-pulse laser beam 17 can pass to the plasma formation region 4, and a window 28 through which the main laser beam 19 can pass to the plasma formation region. A mirror 29 is used to direct the main laser beam 19 through an opening in the contamination trap 26 to the plasma formation region 4.

As in the embodiment of FIG. 2, the radiation source SO of FIG. 4 further comprises a camera 10 arranged to obtain images of the plasma 7. The camera 10 is arranged to transmit images of the plasma 7 to a controller 11 over a connection 12. The controller 11 is configured to process the received images to automatically determine one or more image properties of the plasma 7 and to provide instructions to one or more of the components of the radiation system. In particular, the controller 11 is connected to the main laser 18 and the fuel emitter 3 such that instructions may be provided to the main laser 18 and the fuel emitter 3 as described above with reference to the laser 1 and fuel emitter 3 of FIG. 2.

It will be appreciated that the controller 11 may provide instructions to any suitable components of the radiation source SO in response to the images of the plasma 7 received from the camera 10. In FIG. 4, for example, the controller 11 is connected to the pre-pulse laser 16 via a connection 30 and to the contamination trap 26 via a connection 31. In this way, for example, operation of the pre-pulse laser 16 can be controlled to achieve a desired change in the fuel before the firing of the main laser 18. In this way, properties of the generated plasma 7, and therefore debris emitted by the plasma 7, may be adjusted. Similarly, the controller 11 may provide instructions to the contamination trap 26. For example, where the contamination trap 26 comprises a rotating foil trap comprising a plurality of vanes, instructions may be provided to adjust a speed of rotation and/or an angle of vanes within the rotating foil trap. In this way, the contamination trap 26 may be adjusted as part of the control loop operated by the controller 11 to reduce detrimental effects of debris.

Figure 5:
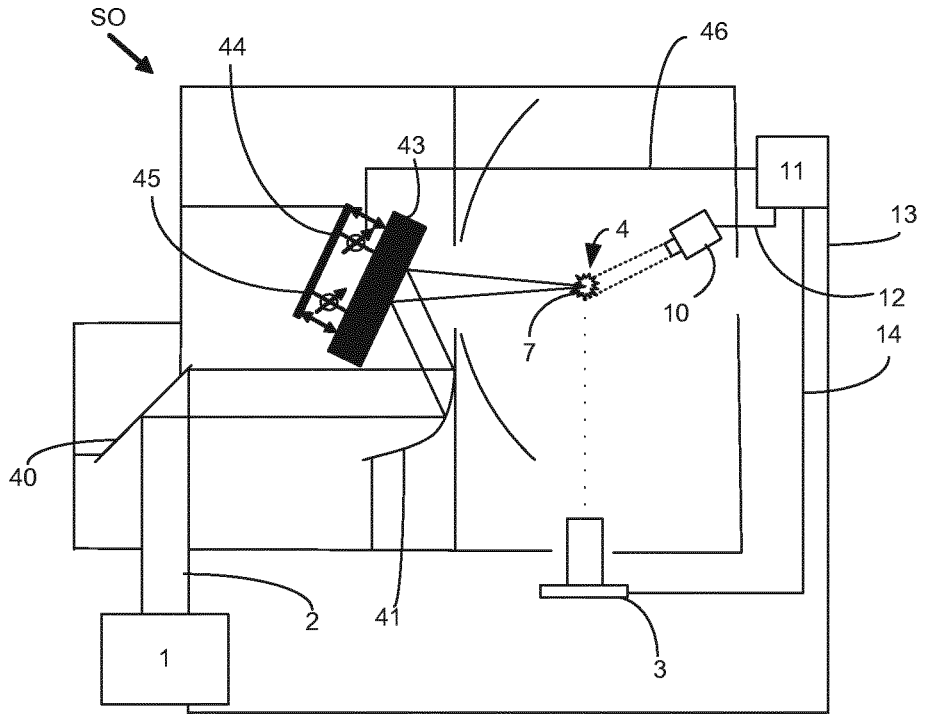
FIG. 5 schematically depicts an alternative radiation source according to an embodiment of the invention.

FIG. 5 schematically illustrates a further example of a radiation system including a radiation source SO. The radiation system of FIG. 5 is arranged similarly to the radiation source SO of FIG. 1 and like components are provide with like reference numerals. In particular, a laser 1 is arranged to deposit energy via a laser beam 2 into a fuel, which is provided from a fuel emitter 3. The laser beam 2 is incident upon the fuel at a plasma formation region 4. The deposition of laser energy into the fuel creates a plasma 7 at the plasma formation region 4.

In the radiation source SO of FIG. 5, components of a focusing assembly, between the laser 1 and the plasma formation region 4, are schematically illustrated. In particular, two fixed reflective elements 40, 41 and a moveable reflective element 42 collectively direct and focus the laser beam 2 towards plasma formation region 4. It will be appreciated that while the reflector elements 40, 41 are fixed in the embodiment of FIG. 5, the reflector elements 40, 41 may also be moveable. Indeed, it is to be understood that any appropriate number fixed reflector elements and/or movable reflector elements may be used to direct and focus the laser beam 2 towards the plasma formation region 4. Furthermore, in other embodiments of the invention, any appropriate focussing element(s) (i.e., other than reflector elements) may be used to focus laser beam 2.

The moveable reflector element 43 forms part of a radiation directing device. The reflector element 43 of the radiation directing device is located in the path of the laser beam 2. The radiation directing device also comprises at least one reflector actuator that is mechanically linked to the reflector element 43. In this case, the radiation directing device comprises two reflector actuators 44, 45 which are mechanically linked to the reflector 43. Movement of at least one of the reflector actuators 44, 45 changes the orientation and/or position of the reflector 43 relative to the path of the laser beam 2. In this way, each reflector actuator 44, 45 can be actuated in order to adjust the orientation and/or position of the reflector 43 relative to the laser beam 2 so as to alter the focus position of the laser beam 2.

It will be appreciated that although two reflector actuators 44, 45 are shown in FIG. 4, in other embodiments there may be any appropriate number of reflector actuators. Furthermore, it will be appreciated that the actuators may alter any appropriate property of the reflector that will alter the focus position of the radiation beam. For example, the actuator may change the shape of the reflector. Although the radiation directing device of the present embodiment comprises a reflector 43, in other embodiments the radiation directing device may comprise any appropriate directing element that is capable of altering the focus position of the laser beam 2. For example, the radiation directing device may comprise a plurality of lens elements, the properties of each lens element being adjustable.

As in the embodiments schematically illustrated in FIGS. 2 and 4, in the embodiment of FIG. 5, a camera 10 is arranged to obtain images of the plasma 7. The camera 10 is connected to a controller 11 via a connection 12. The controller 11 is configured to process images of the plasma 7 received from the camera 10 to determine image properties regarding the plasma 7. The controller 11 uses the determined image properties to generate instructions to components of the radiation system. In particular, the controller 11 is connected to the laser 1 via a connection 13 and to the fuel emitter 3 by a connection 14. In the embodiment of FIG. 5, the controller 11 is further connected the actuators 44, 45 via a connection 46. In this way, the controller 11 can transmit instructions to the actuators 44, 45 in order to adjust the propagation of the laser beam 2 in response to feedback indicating changing image properties of the plasma 7 from the camera 10.

It is to be understood that the arrangements schematically illustrated in FIGS. 2, 5 and 5 are merely exemplary and that features illustrated in one of FIG. 2, 4 or 5 may be combined with features illustrated in another of FIGS. 2, 4 and 5. For example, the embodiment of FIG. 4 may utilise a near normal incidence collector in place of the grazing incidence collector 20. Similarly, the embodiments of FIGS. 2 and 5 may comprise contamination traps such as the contamination trap 26 illustrated in FIG. 4. Furthermore, each of the radiation sources SO shown in FIGS. 2, 4 and 5 may include components which are not illustrated. For example, a spectral filter may be provided in the radiation source SO. The spectral filter may be substantially transmissive for EUV radiation but substantially blocking for other wavelengths of radiation such as infrared radiation.

Figure 6:
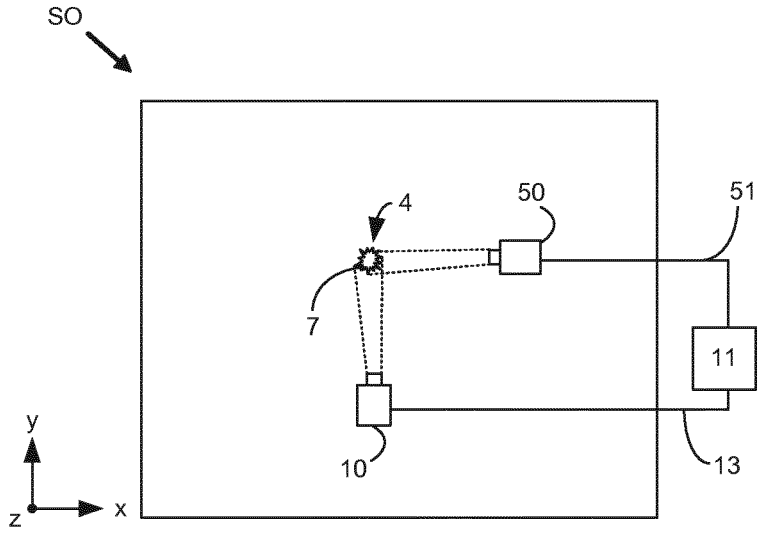
FIG. 6 schematically depicts an alternative radiation source according to an embodiment of the invention.

FIG. 6 schematically illustrates a further example of a radiation source SO according to an embodiment of the present invention in which two cameras are utilised to image the plasma 7. For clarity, many components of the radiation source SO have been omitted from the schematic illustration of FIG. 6. It is to be understood that non-depicted features of the radiation source SO (and the radiation system of which it is a part), such as one or more lasers, a fuel emitter and components of a focussing assembly may be implemented in any appropriate way. For example, the non-depicted components of the radiation source SO of FIG. 6 may be arranged according to one or a combination of the examples schematically illustrated in FIG. 2, 4 or 5.

In FIG. 6, a first camera 10 and a second camera 50 are provided within the radiation source SO to obtain images of a radiation emitting plasma 7. The first camera 10 is arranged to obtain images of the plasma in a first plane, while the second camera 50 is arranged to obtain images of the plasma in a second plane. The second plane may be substantially orthogonal to the first plane. Example axis are shown on FIG. 6, from which it can be seen that the first camera 10 is arranged to obtain images of the plasma 7 in an x-y plane, while the second camera 50 is arranged to obtain images of the plasma 7 in a x-z plane.

The first camera 10 is connected to a controller 11 via a connection 13 while the second camera 50 is connected to the controller 11 via a connection 51. Both the first camera 10 and the second camera 50 are arranged to transmit images of the plasma 7 to the controller 11. The controller 11 is configured to calculate one or more image properties based on the images received from each of the first camera 10 and the second camera 50. By providing images of the plasma 7 in two planes, it is possible to determine a more accurate indication of image properties of the plasma 7, and as a result more accurate indications of image properties of debris emitted as a result of generation of the plasma 7. For example, by providing images in two substantially orthogonal planes, a direction of the debris, in three spatial dimensions, may be determined.

The controller 11 is configured to provide instructions to one or more other components (not shown in FIG. 6) of the radiation system in order to mitigate deleterious effects of debris.

In the embodiments described above, the controller 11 is a digital controller. It is to be understood, however, that the imaging device(s) and/or the controller may be implemented as analogue components. For example, the imaging device(s) may comprise an analogue segmented photo-detector (which may be segmented, for example, in a grid and/or concentric-circular fashion). Each segment of the segmented photo-detector may provide a respective analogue signal to the controller. In one embodiment, for example, the imaging device may be implemented as a quad-cell photo-detector wherein the elipticity of a plasma 7 may be determined based on the signal generated by each respective cell of the photo-detector. That is, properties such as elipticity of the plasma 7 may be inherently indicated within signals transmitted from the imaging device to the controller 11.

The controller may comprise an analogue signal processor arranged to process analogue signals received from the imaging device(s). In this case, the instructions generated by the controller may take the form of analogue control signals suitable for controlling one or more components. It will be appreciated, therefore, that embodiments may comprise an entirely analogue control loop for reducing a detrimental effect of debris.

Figure 7:
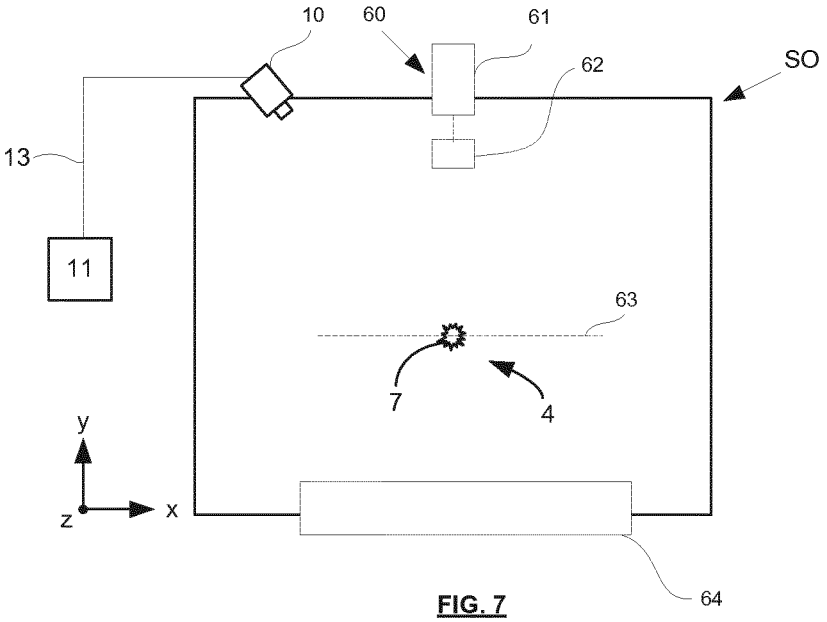
FIG. 7 schematically depicts an alternative radiation source according to an embodiment of the invention.

FIG. 7 schematically illustrates an alternative embodiment. In particular, the embodiment of FIG. 7 uses techniques similar to those used in velocimetry methods such as Particle Image Velocimetry (PIV) and Particle Tracking Velocimetry (PTV). Generally, velocimetry techniques are used to obtain information relating to the flow of fluids, whereby the fluid under observation is seeded with tracer particles. The tracer particles are then tracked and their movement is used to determine properties of the flow of the fluid within which they are suspended. The present inventors have realised, however, that similar techniques can be used to obtain information about debris emanating from the plasma formation region of a radiation source SO, which information can be used to control components of the radiation source SO in real-time (as in the embodiments described above with reference to FIGS. 2, 4, 5 and 6) so as to reduce debris and/or to mitigate detrimental effects of the debris.

Information about the direction and speed of debris particles, obtained using velocimetry techniques, may be complemented with particle sizing information, based on, for example, Mie scattering of photons from each of the particles.

In FIG. 7 the radiation source SO is shown. As in FIG. 6, for reasons of clarity, many components of the radiation source SO are not depicted. It is to be understood that non-depicted features of the radiation source SO (and the radiation system of which it is a part), such as one or more lasers, a fuel emitter and components of a focussing assembly may be implemented in any appropriate way. For example, the non-depicted components of the radiation source SO of FIG. 7 may be arranged according to one or a combination of the examples schematically illustrated in FIG. 2, 4 or 5.

In FIG. 7, an illumination source is provided. The illumination source 60 is arranged to illuminate an area including and surrounding the plasma formation region 4, and therefore debris particles emitted from the plasma formation region 4, for imaging by the camera 10. In the example embodiment of FIG. 7 the illumination source 60 comprises a laser 61 together with conditioning optics 62. The laser 61 is arranged to provide a coherent, low-divergent, pulse of laser radiation. As particles emanating from the plasma formation region 4 may be traveling at high velocities, each laser pulse provided by the laser 61 lasts only a short time. In some embodiments, the laser pulse duration may be less than 10 ns.

The laser 61 is operable to provide a pair of laser beam pulses for each fuel target, each pulse in the pair being provided in rapid succession. For example, the laser 61 may be configured to provide a pair of pulses with a delay between each pulse of, or below, 10 ms. Each laser pulse provided by the laser 61 may have the same polarization, and may be of a different wavelength to both a main (initiating) laser beam and, where present, a pre-pulse laser beam (as described above). In this way, detrimental interference between the laser pulses provided by the laser 61 and laser beams provided by the main or pre-pulse laser may be mitigated.

The conditioning optics 62 are arranged to condition the laser beam to provide laser radiation with a desired power distribution. In some embodiments, the conditioning optics 62 may comprise a set of lenses (not shown) arranged to expand the laser beam. The set of lenses may comprise a spherical lens. The expanded laser beam may then be provided to a cylindrical lens (not shown) arranged to compress the expanded laser beam to provide illumination radiation in the form of a sheet of laser radiation 63. The illumination source 60 may provide laser beam pulses with a power of the order of 1 mJ to 200 mJ.

It will be appreciated that in other embodiments, the illumination source may take other forms. For example, while laser radiation may be preferable, in other embodiments, alternative radiation sources may be used.

The camera 10 is arranged to obtain images of an area around the plasma formation region 4 during plasma generation. In some embodiments, however, where a pre-pulse of laser radiation is provided (such as in the embodiment described with reference to FIG. 4) the camera 10 may additionally or alternatively be arranged to obtain images of the fuel droplet (and surrounding area) during incidence of the pre-pulse on the fuel target. In this way, measurements of debris ejected from the fuel target as a result of interaction with the pre-pulse may also be determined. The camera 10 may be provided with an optical filter (not shown), which is substantially transparent to radiation having a wavelength of radiation produced by the laser 61, and substantially opaque to radiation having a wavelength of radiation produced by a pre-pulse or main laser. The filter may also substantially block radiation from plasma formed by the main laser. For example, in some embodiments the laser 61 is arranged to produce laser beams with a wavelength of 532 nm, and a 532 nm bandpass filter may be provided.

In the embodiment of FIG. 7, the camera 10 is arranged to obtain two images, with each being in a different frame. In particular, the camera 10 is arranged to obtain a first image frame to correspond with the first of a pair of pulses of the laser 61 and to obtain a second image frame to correspond with the second of the pair of pulses of the laser 61. It will be appreciated, therefore, that in the embodiment of FIG. 7, the camera 10 is able to obtain respective image frames in rapid succession to match the Interval between pulses of the laser 61. The camera 10 may take any form suitable for obtaining the pair of image frames, and in some embodiments may be a CCD camera.

The illumination source 60 is arranged to illuminate the x-z plane at the plasma formation region 4 at the points in time at which each image frame is obtained by the camera 10. Particles emitted from the plasma formation region within the x-z plane are illuminated within each image frame obtained by the camera 10. Each of two image frames obtained by the camera 10 therefore provides a snapshot of debris emitted from the plasma formation region 4 at a different point in time within the x-z plane.

It will be appreciated that while the illumination sheet 63 is described as being within the x-z plane, the illumination sheet 63 may take any orientation so as to image debris particles in other planes. In some embodiments, the conditioning optics 62 may allow the illumination sheet 63 to be rotated through a plurality of different planes within the exposure of a single frame. For example, where a cylindrical lens is provided to flatten the radiation beam provided by the laser 61, the cylindrical lens may be rotatable. Such rotation of a planar illumination sheet may be referred to as scanning PIV, and may be used to provide a volumetric representation of the plasma formation region.

Figure 8:
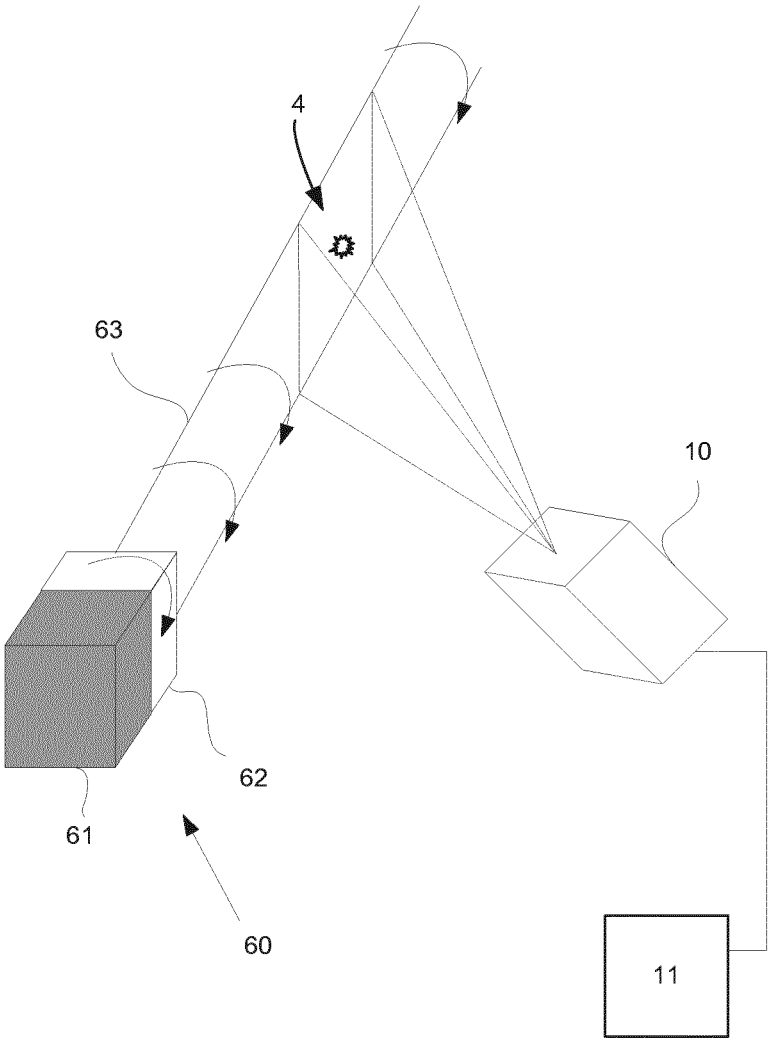
FIG. 8 schematically depicts an imaging system of the radiation source of FIG. 7.

By way of example, FIG. 8 schematically illustrates an embodiment of the illumination source 60 and camera 10 in which the conditioning optics 62 are arranged to rotate the radiation sheet 63 through a plurality of angles. As described above, the laser 61 provides laser radiation to the conditioning optics 62. The conditioning optics may comprise one or more cylindrical lenses arranged to focus the laser radiation onto a line, thereby forming the illumination sheet 63. The conditioning optics 62 further comprise rotation means, configured to rotate the one or more cylindrical lenses about the optical axis of the radiation sheet 63.

Rotation of the cylindrical lenses within the conditioning optics 62 causes the radiation sheet 63 to rotate about its optical axis, thereby illuminating a plurality of planes within the plasma formation region 4. The camera 10 is configured to obtain a plurality of two-dimensional images as the conditioning optics 62 rotate the radiation sheet 63. It will be appreciated that the radiation sheet 63 may be rotated through 180 degrees, such that the camera is able to obtain a plurality of two-dimensional images, which together cover a three-dimensional volume of the plasma formation region 4. Alternatively, the radiation sheet 63 may be rotated through a predetermined, non-180 degree angle. In an embodiment, the radiation sheet 63 may be in continuous rotation, therefore rotating through 360 degrees.

It is described in more detail below that two image frames are compared, in order to track particles within the plasma formation region 4. It is to be understood that where the conditioning optics 62 are configured to rotate the radiation sheet 63 through a plurality of angles, it is image frames obtained at corresponding times during different laser pulses that are compared, not image frames obtained during a single laser pulse (or the same rotation). For example, where during rotation of a first laser pulse a first, second and third image may be obtained by the camera 10, and during a second laser pulse, a first, second and third image may be obtained, the two first images may be compared, the two second images may be compared and the two third images may be compared.

In an embodiment, the conditioning optics 62 comprises a single cylindrical lens arranged to focus a radiation beam onto a line that passes through the plasma formation region 4 upstream (i.e. closer to the illumination source 60) of the fuel target. In this way, a sheet of radiation is provided that passes through plasma formation region 4. For example, where a single cylindrical lens is provided, the Illumination radiation enters the enclosing structure of the source SO with a generally cylindrical shape, expands towards a line near the plasma formation region.

In an alternative embodiment, two cylindrical lenses may be provided within the conditioning optics 62, the two cylindrical lenses rotating in synchrony. The cylindrical lenses may be mounted to a stage, or connected together, such that a relative orientation of the two cylindrical lenses with respect to the laser 61 does not change during rotation. The provision of two cylindrical lenses allows the laser radiation to be formed into a sheet (or curtain) before entering the enclosing structure of the source SO. In this way, depth of focus may be improved. However, where two cylindrical lenses are provided, an intensity of the radiation sheet 63 may be greater at positions of the source at which there are optical components such as viewports, which may result in optical damage to such components.

It will be appreciated that the one or more lenses may be rotated using any suitable mechanism. For example, the one or more cylindrical lenses may be mounted on a rotatable stage within the conditioning optics 62. A motor may be coupled with the rotating stage in order to provide rotational movement.

By providing a rotating radiation sheet 63, a three-dimensional volume may be imaged with a single camera. This may be advantageous. In particular, use of multiple cameras to image a volume requires additional viewports which may be difficult to provide. Further, it has been observed that interference effects may be present in multi-camera imaging systems, resulting in recording of particles which are not present in the plasma formation region. Further, where images are obtained with multiple cameras, significant processing resources may be required to process each image to generate a three-dimensional volume. Embodiments such as shown in FIG. 8 provide imaging of a three-dimensional volume which do not suffer these drawbacks.

In order to ensure that the timing between the camera 10 and the illumination source 60 is accurate, the illumination source 60 and the camera 10 may be connected to a shared trigger mechanism (not shown). Such a shared trigger mechanism may be implemented in any convenient way. For example, a suitable trigger may be based upon a firing of an initiating (main), or pre-pulse, laser and/or may be based upon signals received from sensors tracking a progression of a fuel target to the plasma formation region 4.

The source SO of FIG. 7 further comprises a radiation dump 64 substantially in-line with the direction of propagation of the illumination sheet 63. The radiation dump 64 acts to absorb the radiation of the Illumination sheet 63 to prevent reflection from other surfaces within the radiation source SO. The radiation dump 64 therefore helps to provide a substantially dark background to the images obtained by the camera 10.

The two image frames obtained by the camera 10 are passed to the controller 11 for processing via the connection 13. The controller 11 processes the two images to provide information regarding debris emanating from the plasma formation region 4. For example, the images may be processed in the same way as images obtained using PIV are processed. Such processing will be known to persons skilled in the art and as such is not described in detail herein.

In general, however, the first and second image frames may each be split into a plurality sections, be correlated (using, for example, cross-correlation of the two frames) to calculate a displacement vector for each section. The time delay between the two images, together with the change in position can be used to determine the speed with which those debris particles are emanating from the plasma formation region 4. The size of the debris particles may be determined based upon Mie scattering. That is, by measuring the intensity of the images of debris particles imaged by the camera 10 (indicative of the number of photons scattered by those particles in the direction of the camera 10) the controller 11 can determine an indication of the size of the debris particles.

The processing of images obtained by the camera 10 in the embodiment of FIG. 7 enables detection of debris particles larger than 0.1 μm. In contrast, prior art methods, such as imaging based on shadowgraph techniques, which illuminate a target with diffuser filtered laser radiation, are generally capable of imaging features with a resolution of only 5 μm and above. Additionally, a wider field-of-view, and a greater depth-of-field, can be achieved in the images obtained using the arrangement of FIG. 7 in comparison to those that may be obtained using shadowgraph-based methods.

While in FIG. 7 only a single camera is depicted, it is to be understood that more than one camera may be used. For example, one or more, additional cameras may be arranged to image the plasma formation region from a different angle to the camera 10 (similarly to as described above with reference to FIG. 6). Where a plurality of cameras are provided, each camera may be arranged to image the plasma formation region at a different angle. The provision of two or more cameras can be used to obtain three-dimensional views of the plasma formation region.

Additionally, while it is described above that the conditioning optics are arranged to provide a single sheet of illumination for each image, in other embodiments, the conditioning optics 62 may comprise optics arranged to provide laser beams of different forms, dimensions and orientations. For example, in some embodiments, the illumination source 60 may be arranged to provide a plurality of planar sheets of radiation, each sheet having a different polarization. A plurality of cameras may be provided, each camera comprising a polarisation filter to reflections from only one of the sheets. In other embodiments, a volume of illumination (rather than a sheet) may be provided.

It is described above that techniques similar to those used in PIV may be utilised to determine a velocity of debris particles emitted from a plasma. It is to be understood that in other embodiments, other velocimetry techniques may be used in addition to, or in place of, PIV techniques. For example, in some embodiments, Particle Tracking Velocimetry (PTV) may be used by tracking the location of individual particles across a plurality of frames obtained by the camera 10 (or by a plurality of cameras where provided).

It is described above, with reference to FIG. 7 that the camera 10 is operable to obtain two image frames, each frame timed with one of a pair of laser pulses provided by the illumination source 60. In some embodiments, however, the camera 10 may be arranged to obtain the two images in a single frame. That is, where a single frame is obtained, the single frame will comprise a first image of the plasma formation region for the first of the pair of laser pulses, and a second image of the plasma formation region for the second of the pair of laser pulses. In such embodiments, additional processing may be required to determine which features depicted in the frame were imaged at the first laser pulse and which features were imaged at the second laser pulse. A single frame comprising two images of plasma formation region at different times may be auto-correlated to determine a speed and direction of the imaged debris particles.

In an embodiment, the radiation source SO of the invention may form part of a mask inspection apparatus. The mask inspection apparatus may use EUV radiation to illuminate a mask and use an imaging sensor to monitor radiation reflected from the mask. Images received by the imaging sensor are used to determine whether or not defects are present in the mask. The mask inspection apparatus may include optics (e.g. mirrors) configured to receive EUV radiation from an EUV radiation source and form it into a radiation beam to be directed at a mask. The mask inspection apparatus may further include optics (e.g. mirrors) configured to collect EUV radiation reflected from the mask and form an image of the mask at the imaging sensor. The mask inspection apparatus may include a processor configured to analyse the image of the mask at the imaging sensor, and to determine from that analysis whether any defects are present on the mask. The processor may further be configured to determine whether a detected mask defect will cause an unacceptable defect in images projected onto a substrate when the mask is used by a lithographic apparatus.

In an embodiment, the radiation source SO may form part of a metrology apparatus. The metrology apparatus may be used to measure alignment of a projected pattern formed in resist on a substrate relative to a pattern already present on the substrate. This measurement of relative alignment may be referred to as overlay. The metrology apparatus may for example be located immediately adjacent to a lithographic apparatus and may be used to measure the overlay before the substrate (and the resist) has been processed.

Although specific reference may be made in this text to embodiments of the invention in the context of a lithographic apparatus, embodiments of the invention may be used in other apparatus. Embodiments of the invention may form part of a mask inspection apparatus, a metrology apparatus, or any apparatus that measures or processes an object such as a wafer (or other substrate) or mask (or other patterning device). These apparatus may be generally referred to as lithographic tools. Such a lithographic tool may use vacuum conditions or ambient (non-vacuum) conditions.

The term "EUV radiation" may be considered to encompass electromagnetic radiation having a wavelength within the range of 5-20 nm, for example within the range of 13-14 nm. EUV radiation may have a wavelength of less than 10 nm, for example within the range of 5-10 nm such as 6.7 nm or 6.8 nm.

Although specific reference may be made in this text to the use of lithographic apparatus in the manufacture of ICs, it should be understood that the lithographic apparatus described herein may have other applications. Possible other applications include the manufacture of Integrated optical systems, guidance and detection patterns for magnetic domain memories, flat-panel displays, liquid-crystal displays (LCDs), thin-film magnetic heads, etc.

Embodiments of the Invention may be implemented in hardware, firmware, software, or any combination thereof. Embodiments of the invention may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g. carrier waves, infrared signals, digital signals, etc.), and others. Further, firmware, software, routines, instructions may be described herein as performing certain actions. However, it should be appreciated that such descriptions are merely for convenience and that such actions in fact result from computing devices, processors, controllers, or other devices executing the firmware, software, routines, instructions, etc.

Clauses:

a. A radiation system configured to generate a radiation emitting plasma, the radiation system comprising:

a fuel emitter configured to provide a fuel target at a plasma formation region;

a first laser arranged to provide a first laser beam at the plasma formation region incident on the fuel target to generate a radiation emitting plasma;

an imaging device arranged to obtain a first image of the radiation emitting plasma at the plasma formation region, the first image indicating an image property of the radiation emitting plasma; and a controller arranged to:

receive the first image, and generate an instruction based on the image property of the radiation emitting plasma to modify operation of a component of the radiation system to reduce a detrimental effect of debris.

b. The radiation system of clause b, wherein the image property comprises an amount and/or a direction of debris from generation of the radiation emitting plasma.

c. The radiation system of clause a or clause b, wherein the instruction is suitable to alter an interaction between the first laser beam and a fuel target.

d. The radiation system of any of clauses a to c, wherein the instruction comprises an instruction to cause the fuel emitter to modify a property of the fuel target provided at the plasma formation region.

e. The radiation system of clause d, wherein the image property of the fuel target comprises at least one selected from: speed, direction of propagation, size and/or shape of the fuel target.

f. The radiation system of any of clauses a to e, wherein the Instruction comprises an instruction suitable to modify a first laser property of the first laser beam.

g. The radiation system of clause f, wherein the first laser property of the first laser beam comprises at least one selected from: repetition rate, power, intensity profile, direction of propagation and/or position of the first laser beam.

h. The radiation system of any of clauses a to g, further comprising a second laser arranged to provide a second laser beam incident on the fuel target to alter a fuel property of the fuel target before the first laser beam is incident on the fuel target; and wherein the instruction comprises an instruction suitable to modify a second laser property of the second laser beam.

i. The radiation system of any of clauses a to h, wherein the image property of the radiation emitting plasma comprises at least one selected from: angle, intensity profile and/or ellipticity of the radiation emitting plasma.

j. The radiation system of clause i, wherein the instruction is suitable to alter at least one selected from: angle, intensity profile and/or ellipticity of the radiation emitting plasma.

k. The radiation system of any of clauses a to j, further comprising a contamination trap, wherein the instruction comprises an instruction suitable to cause debris to be emitted substantially in a direction of the contamination trap.

l. The radiation system of any of clauses a to k, further comprising a contamination trap, wherein the instruction comprises an instruction suitable to alter operation of the contamination trap to trap a greater portion of emitted debris.

m. The radiation system of any of clauses a to l, further comprising a second imaging device arranged to obtain a second image of the radiation emitting plasma at the plasma formation location; and wherein the controller is arranged to:

receive the second image, and determine the image property of the radiation emitting plasma from the first and second images.

n. The radiation system of clause m, wherein the first imaging device is arranged to obtain images in a first plane and the second imaging device is arranged obtain images in a second plane substantially orthogonal to the first plane.

o. The radiation system of clause m or clause m, wherein the first imaging device is arranged to obtain images in a plane substantially parallel to a direction of propagation of the first laser beam and at about 45 or about 225 degrees with respect to a direction of propagation of the fuel target, and wherein the second imaging device is arranged to obtain images in a plane substantially parallel to a direction of propagation of the first laser beam and at about −45 or about −225 degrees with respect to the direction of propagation of the fuel target.

p. The radiation system of any of clause a to o, wherein the instruction is suitable to minimize a quantity of debris generated by generation of the radiation emitting plasma.

q. The radiation system of any of clause a to p, further comprising a focusing assembly having a movable optical component, wherein the Instruction is suitable to cause movement of the movable optical component.

r. The radiation system of any of clause a to q, further comprising an illumination source arranged to provide first illumination radiation to illuminate the plasma formation region when the imaging device obtains the first image;

wherein the imaging device is arranged to obtain a second image of the radiation emitting plasma at a certain time after obtaining the first image and the illumination source is arranged to provide second illumination radiation when the imaging device obtains the second image;

wherein the controller is arranged to process the first and second images to determine at least one selected from: size, speed and/or direction of a particle emitted from the radiation generated plasma; and wherein generation of the instruction is based upon the determined size, speed and/or direction of the particle emitted from the radiation generated plasma.

s. The radiation system of clause r, wherein the illumination source comprises a laser arranged to emit an illumination laser beam pulse and a conditioning optic arranged to condition the laser beam pulse to provide the first and second illumination radiation.

t. The radiation system of clause s, wherein the conditioning optic is arranged to flatten the first and second illumination radiation to provide substantially planar radiation.

u. The radiation system of clause t, wherein the conditioning optic is arranged to rotate the first and second radiation through a plurality of planes.

v. The radiation system of clause u, wherein the conditioning optic comprises a single rotatable cylindrical lens or a plurality of rotatable cylindrical lenses.

w. The radiation system of any of clauses r to v, wherein the illumination source is arranged such that the first and second illumination radiation each comprise a volume of illumination.

x. The radiation system of any of clauses r to w, wherein the certain time between obtaining the first and second images is less than or equal to approximately 10 ms.

y. The radiation system of any of clauses r to x, wherein the controller is arranged to determine a size of the particle emitted from the radiation generated plasma by determining from the first and/or second image a property of photons scattered by the particle.

z. The radiation system of clause y, wherein the controller is arranged to determine a size of the particle by processing the determined property of photons using the Mie solution for the scattering of electromagnetic radiation by a sphere.

α. The radiation system of any of clauses r to z, wherein determining a distance and/or a speed of the particle comprises cross-correlating the first and second images.

β. The radiation system of any of clauses r to α, wherein determining a distance and/or a speed comprises processing the first and second images using a velocimetry technique to determine a velocity of the particle.

γ. A method of generating a radiation emitting plasma in a radiation system, the radiation system comprising:

a fuel emitter configured to provide a fuel target at a plasma formation region;

a first laser arranged to provide a first laser beam at the plasma formation region incident on the fuel target to generate a radiation emitting plasma;

an imaging device arranged to obtain images of a radiation emitting plasma at the plasma formation region, the images indicating an image property of the radiation emitting plasma; and a controller;

the method comprising at the controller:

receiving a first image of a radiation emitting plasma; and generating an instruction based on the image property of the radiation emitting plasma to modify operation of a component of the radiation system to reduce a detrimental effect of debris.

δ. A lithographic tool comprising a radiation system according to any of clauses a to β.

ε. A radiation source configured to generate a radiation emitting plasma, the radiation source arranged to receive a laser beam at a plasma formation region and comprising:

a fuel emitter configured to provide a fuel target at the plasma formation region;

an imaging device arranged to obtain a first image of a radiation emitting plasma at the plasma formation region, the first image indicating an image property of the radiation emitting plasma; and a controller arranged to:

receive the first image, and generate an instruction based on the image property of the radiation emitting plasma to modify operation of a component of a radiation system to reduce a detrimental effect of debris.

ζ. A non-transitory computer readable medium carrying computer readable instructions suitable to cause a computer to:

receive a first image of a radiation emitting plasma indicating an image property of the radiation emitting plasma; and generate an instruction based on the image property of the radiation emitting plasma to modify operation of a component of a radiation system to reduce a detrimental effect of debris.

While specific embodiments of the Invention have been described above, it will be appreciated that the invention may be practiced otherwise than as described. The descriptions above are intended to be illustrative, not limiting. Thus it will be apparent to one skilled in the art that modifications may be made to the invention as described without departing from the scope of the claims set out below.

The invention claimed is:

1. A radiation system configured to generate a radiation emitting plasma, the radiation system comprising:

a fuel emitter configured to provide a fuel target at a plasma formation region;

a first laser arranged to provide a first laser beam, at the plasma formation region, incident on the fuel target to generate a radiation emitting plasma;

an imaging device arranged to obtain a first image of the radiation emitting plasma at the plasma formation region, a radiation emitting plasma portion itself of the first image indicating an image property of the radiation emitting plasma; and a controller arranged to:

receive the first image, and generate an instruction based on the image property of the radiation emitting plasma to modify operation of a component of the radiation system to reduce a detrimental effect of debris, the image property comprising an amount and/or a direction of debris from generation of the radiation emitting plasma.

2. The radiation system of claim 1, wherein the instruction is suitable to alter an interaction between the first laser beam and a fuel target.

3. The radiation system of claim 1, wherein the instruction comprises an instruction suitable to modify a first laser property of the first laser beam.

4. The radiation system of claim 1, further comprising a second laser arranged to provide a second laser beam incident on the fuel target to alter a fuel property of the fuel target before the first laser beam is incident on the fuel target; and wherein the instruction comprises an instruction suitable to modify a second laser property of the second laser beam.

5. The radiation system of claim 1, further comprising a second imaging device arranged to obtain a second image of the radiation emitting plasma at the plasma formation location; and wherein the controller is arranged to:

receive the second image, and determine the image property of the radiation emitting plasma from the first and second images.

6. The radiation system of claim 5, wherein the first imaging device is arranged to obtain images in a first plane and the second imaging device is arranged obtain images in a second plane substantially orthogonal to the first plane.

7. The radiation system of claim 1, wherein the instruction is suitable to minimize a quantity of debris generated by generation of the radiation emitting plasma.

8. The radiation system of claim 1, further comprising an illumination source arranged to provide first illumination radiation to illuminate the plasma formation region when the imaging device obtains the first image;

wherein the imaging device is arranged to obtain a second image of the radiation emitting plasma at a certain time after obtaining the first image and the illumination source is arranged to provide second illumination radiation when the imaging device obtains the second image;

wherein the controller is arranged to process the first and second images to determine at least one selected from: size of a particle emitted from the radiation generated plasma, speed of a particle emitted from the radiation generated plasma and/or direction of a particle emitted from the radiation generated plasma; and wherein generation of the instruction is based upon the determined size, speed and/or direction of the particle emitted from the radiation generated plasma.

9. The radiation system of claim 8, wherein the illumination source comprises a laser arranged to emit an illumination laser beam pulse and a conditioning optic arranged to condition the laser beam pulse to provide the first and second illumination radiation.

10. The radiation system of claim 8, wherein the certain time between obtaining the first and second images is less than or equal to approximately 10 ms, or wherein the controller is arranged to determine a size of the particle emitted from the radiation generated plasma by determining from the first and/or second image a property of photons scattered by the particle.

11. A method of generating a radiation emitting plasma in a radiation system, the radiation system comprising:

a fuel emitter configured to provide a fuel target at a plasma formation region;

a laser arranged to provide a laser beam, at the plasma formation region, incident on the fuel target to generate a radiation emitting plasma;

an imaging device arranged to obtain an image of the radiation emitting plasma at the plasma formation region, a radiation emitting plasma portion itself of the image indicating an image property of the radiation emitting plasma; and a controller;

the method comprising at the controller:

receiving the image of the radiation emitting plasma; and generating an instruction based on the image property of the radiation emitting plasma to modify operation of a component of the radiation system to reduce a detrimental effect of debris, the image property representing an amount and/or a direction of debris from generation of the radiation emitting plasma.

12. A lithographic tool comprising the radiation system according to claim 1.

13. A radiation source configured to generate a radiation emitting plasma, the radiation source arranged to receive a laser beam at a plasma formation region and comprising:

a fuel emitter configured to provide a fuel target at the plasma formation region;

an imaging device arranged to obtain a first image of a radiation emitting plasma at the plasma formation region, a radiation emitting plasma portion itself of the first image indicating an image property of the radiation emitting plasma, the image property representing an amount and/or a direction of debris from generation of the radiation emitting plasma; and a controller arranged to:

receive the first image, and generate an instruction based on the image property of the radiation emitting plasma to modify operation of a component of a radiation system to reduce a detrimental effect of debris.

14. A non-transitory computer readable medium carrying computer readable instructions that, when executed by a computer system, are configured to cause the computer system to at least:

receive an image of a radiation emitting plasma, a radiation emitting plasma portion itself of the image indicating an image property of the radiation emitting plasma, the image property representing an amount and/or a direction of debris from generation of the radiation emitting plasma; and generate an instruction based on the image property of the radiation emitting plasma to modify operation of a component of a radiation system to reduce a detrimental effect of debris.

15. The medium of claim 14, wherein the generated instruction is suitable to alter an interaction between a laser beam and a fuel target used to generate the radiation emitting plasma.

16. The medium of claim 14, wherein the computer readable instructions are further configured to cause the computer system to receive a second image, and determine an image property of the radiation emitting plasma from the first and second images.

17. The medium of claim 16, wherein the first image is in a first plane and the second image is in a second plane substantially orthogonal to the first plane.

18. The medium of claim 16, wherein the second image is obtained at a certain time after obtaining the first image, wherein the computer readable instructions are further configured to cause the computer system to process the first and second images to determine at least one selected from: size of a particle emitted from the radiation generated plasma, speed of a particle emitted from the radiation generated plasma and/or direction of a particle emitted from the radiation generated plasma, and wherein generation of the instruction is based upon the determined size, speed and/or direction of the particle emitted from the radiation generated plasma.

19. The medium of claim 18, wherein the certain time between obtaining the first and second images is less than or equal to approximately 10 ms, or wherein the computer readable instructions are further configured to cause the computer system to determine a size of the particle emitted from the radiation generated plasma by determining from the first and/or second image a property of photons scattered by the particle.

20. The medium of claim 14, wherein the generated instruction is suitable to modify a laser property of a second laser beam incident on the fuel target to alter a fuel property of the fuel target before the first laser beam is incident on the fuel target.

* * * * *